United States Patent [19]

Schiffers

[11] Patent Number: 5,028,011

[45] Date of Patent: Jul. 2, 1991

[54] METHOD AND APPARATUS FOR WINDING AND CROSSCUTTING A RUNNING FABRIC WEB

[75] Inventor: Theo Schiffers, Wurselen, Fed. Rep. of Germany

[73] Assignee: H. Krantz GmbH & Co., Wurselen, Fed. Rep. of Germany

[21] Appl. No.: 478,637

[22] Filed: Feb. 12, 1990

[30] Foreign Application Priority Data

May 5, 1989 [DE] Fed. Rep. of Germany ..... 3914776

[51] Int. Cl.[5] ..... B65H 19/26; B65H 19/30

[52] U.S. Cl. ..... 242/56 R

[58] Field of Search ..... 242/56 R, 56 A

[56] References Cited

U.S. PATENT DOCUMENTS

| | | | |
|---|---|---|---|
| 3,191,883 | 6/1965 | Wells | 242/56 R |
| 3,610,545 | 10/1971 | Reifenhauser | 242/56 R |
| 3,782,665 | 1/1974 | Byrt et al. | 242/56 R |
| 4,489,900 | 12/1984 | Morizzo | 242/56 R |
| 4,515,321 | 5/1985 | Kahlman | 242/56 R |
| 4,546,930 | 10/1985 | Rohde et al. | 242/56 R |
| 4,901,934 | 2/1990 | Schnell | 242/56 R |

FOREIGN PATENT DOCUMENTS

| | | |
|---|---|---|
| 0132727 | 2/1985 | European Pat. Off. . |
| 3516836 | 11/1986 | Fed. Rep. of Germany . |

*Primary Examiner*—John M. Jillions

*Attorney, Agent, or Firm*—Mark T. Basseches

[57] ABSTRACT

A method and apparatus for winding a running fabric web uninterruptedly on first and then on second takeup rolls following the formation of a transverse cut is disclosed. The web is driven in a path which includes a loop and the second takeup roll is engaged with the loop to drive the second takeup roll and form with the second roll a nip narrowing in the feed direction of the web. The cut end of the web, now being fed by an auxiliary drive, is introduced into the nip thereby to clamp the web to the second takeup roll. An apparatus for practicing the method is likewise disclosed, the apparatus including a first drive for the first takeup roll, a guide for forming a loop of the fabric, a second drive for feeding the fabric independent of the first drive and mechanism for shifting the second takeup roll into driving engagement with the loop.

10 Claims, 2 Drawing Sheets

1
2
3
3
4
5
6
7
8
9
9'
10
11
12
14
15
16
17
18
19
20
20'

METHOD AND APPARATUS FOR WINDING AND CROSSCUTTING A RUNNING FABRIC WEB

BACKGROUND AND FIELD OF THE INVENTION

This invention relates to a method and an apparatus for winding and crosscutting a running fabric web which is wound on a driven takeup roll until a certain coil diameter is reached. Thereupon the takeup roll is shifted perpendicular to its axis from the winding position and a second empty takeup roll, not yet wound, is transferred into the winding position. Lastly a cutter rotating at the running speed of the fabric cuts the fabric web between the full roll and the second take up roll in a direction perpendicular to the running direction of the fabric and the cut end of the fabric connected to the second take up roll.

PRIOR ART

In generally known winding and crosscutting devices complicated arrangements are necessary to bring the new fabric end obtained by cutting the fabric web to the new roll in such a way that the fabric web is securely gripped by the takeup roll at undiminished incoming speed so that proper coil formation can take place. To support this incipient winding process it is known practice to prepare the second takeup roll with an adhesive tape to ensure the fixation and hence the entrainment of the fabric beginning on the second takeup roll before a sufficient coiling of the roll by the fabric is achieved Apart from the fact that the use of an adhesive tape leads to undesirable marks on the fabric, that wet fabrics do not adhere to the adhesive tape or do so insufficiently, and that each takeup roll must be provided with a new adhesive tape for each new winding, the adhesive tape is merely an auxiliary measure, which does not do away with the need for special devices for bringing the fabric beginning to the new takeup roll.

As a device for bringing the new fabric beginning to a takeup roll there is known, for example from EP 0132727 B1, endlessly revolving belts which are passed over guide rollers over a part of the circumference of the takeup roll to be wound in such a way that a nip is formed between the belts and the takeup rolls, into which the fabric end is introduced in order thus to be passed around the takeup roll. Normally the belts consist of toothed belts revolving in spaced relation to each other, which cannot grip the fabric over its full width, resulting in folds in the fabric. Also there is danger that fabric edges get between the toothed belts and guide rollers in the form of pulleys, with the result that the fabric is damaged and the winding process must be interrupted.

Lastly, DE35 16 836 A1 discloses a method and an apparatus in which each takeup roll is prepared with a flag made from a section of the fabric web, so as to form with the flag and the takeup roll a nip into which the new fabric beginning can be introduced. Apart from the expense that this involves, the fabric section forming the flag cannot be used for other purposes and thus is lost for the further processing.

SUMMARY OF THE INVENTION

It is an object of the invention to provide a winding method and apparatus which eliminates the use of adhesive tapes with their attendant marks, which requires no costly auxiliary devices for winding the new fabric beginning on a takeup roll, and which requires no other preparation for doing so.

According to the new method, a fabric section, which remains an integral part of the continuously arriving fabric web, is passed around a portion of the circumference of the still empty takeup roll and in so doing it fulfills two functions. Firstly by looping around the takeup roll the fabric section rotates the latter in such a way that the circumferential speed of the takeup roll and the incoming speed of the fabric are substantially the same. Secondly, the fabric section conjointly with the takeup roll forms a gap narrowing in the running direction of the fabric web, to take up the new fabric end made by the cut and to pass it around the roll at unchanged incoming speed and to clamp it against the roll. Meanwhile a second drive means comprised of a traction roll pair placed above the gap feeds the end of the web resulting from the cut, to the second take up roll to assure that the feed is effected without interruption. Therefore, the new fabric section, driven by the traction roll pair, runs at unchanged speed toward the empty takeup roll. The joining process having thus been initiated, a drive roll previously used to drive the first or filled take up roll can be pressed onto the outer circumference of the second takeup roll now being wound and can replace the function of the traction roll pair. The guide rolls, used to ensure the looping of the second takeup roll with the new fabric section, can be pivoted all together so that they do not hinder the new fabric coil of increasing diameter as winding continues.

Suitable for carrying out the method according to the invention is an apparatus having two takeup rolls, each movable perpendicular to its longitudinal axis, and a driving roll pivotally mounted in support arms and adapted to be pressed against the outer circumference of the fabric coil forming around the takeup rolls. Such an apparatus is thus especially suitable for carrying out the method if according to the invention it is characterized by the following features:

- a second driving roll which is mounted in a pivotable roll stand and can be engaged with the outer circumference of the fabric coil forming around the second takeup roll still to be wound,
- a group of guide rolls mounted in a common cradle which in turn is pivotally mounted on the roll stand,
- two traction rolls mounted in the roll stand side by side and adapted to be pressed against opposed surfaces of the web, at least one roll being driven,
- a cutter rotatably mounted in the roll stand below the rolls to be pressed against one another, and extending over the maximum width of a fabric web,
- the fabric web is conducted around the individual guide rolls in such a way that the cradle with the guide rolls can be pivoted unhindered into a position wherein the fabric web loops the new takeup roll over a portion of its circumference,
- a pivotability of the roll stand and of the cradle with the guide rolls into a position by which a fabric section and the new takeup roll form a gap narrowing in the running direction of the fabric and in circumferential direction of this takeup roll, the opening of which gap lies in a region below a common perpendicular tangent of the two traction rolls.

In order to bring the cradle with the guide rolls selectively into a position wherein the fabric web loops the new takeup roll, and to be able after the joining process, to pivot the cradle with the guide rolls out of the above described joining position unhindered, a variant of the invention provides that each side of the cradle consists of a horizontal stretched leg, a leg oriented perpendicular thereto approximately in the center of the horizontal leg, and a cranked leg angularly connected at one end of the horizontal leg, a guide roll being mounted at the ends of the legs and the cradle being pivotable about the axle of a guide roll mounted on the roll stand.

By this design the cradle with the guide rolls can be pivoted from one to the other position unhindered by the first and second takeup rolls.

A further variant of the invention provides that the roll stand is pivotable about an axle mounted in a frame of the apparatus by means of a cylinder-piston rod unit which also is articulated to the apparatus frame.

Obviously, a comparably articulated cylinder-piston rod unit may be provided also for pivoting the cradle from one to the other position, in which case this cylinder-piston rod unit should then be articulated at the likewise pivotable roll stand.

BRIEF DESCRIPTION OF THE DRAWINGS

An embodiment example of the apparatus according to the invention is represented schematically in the drawings in which.

DETAILED DESCRIPTION OF THE DRAWINGS

Figure 1:
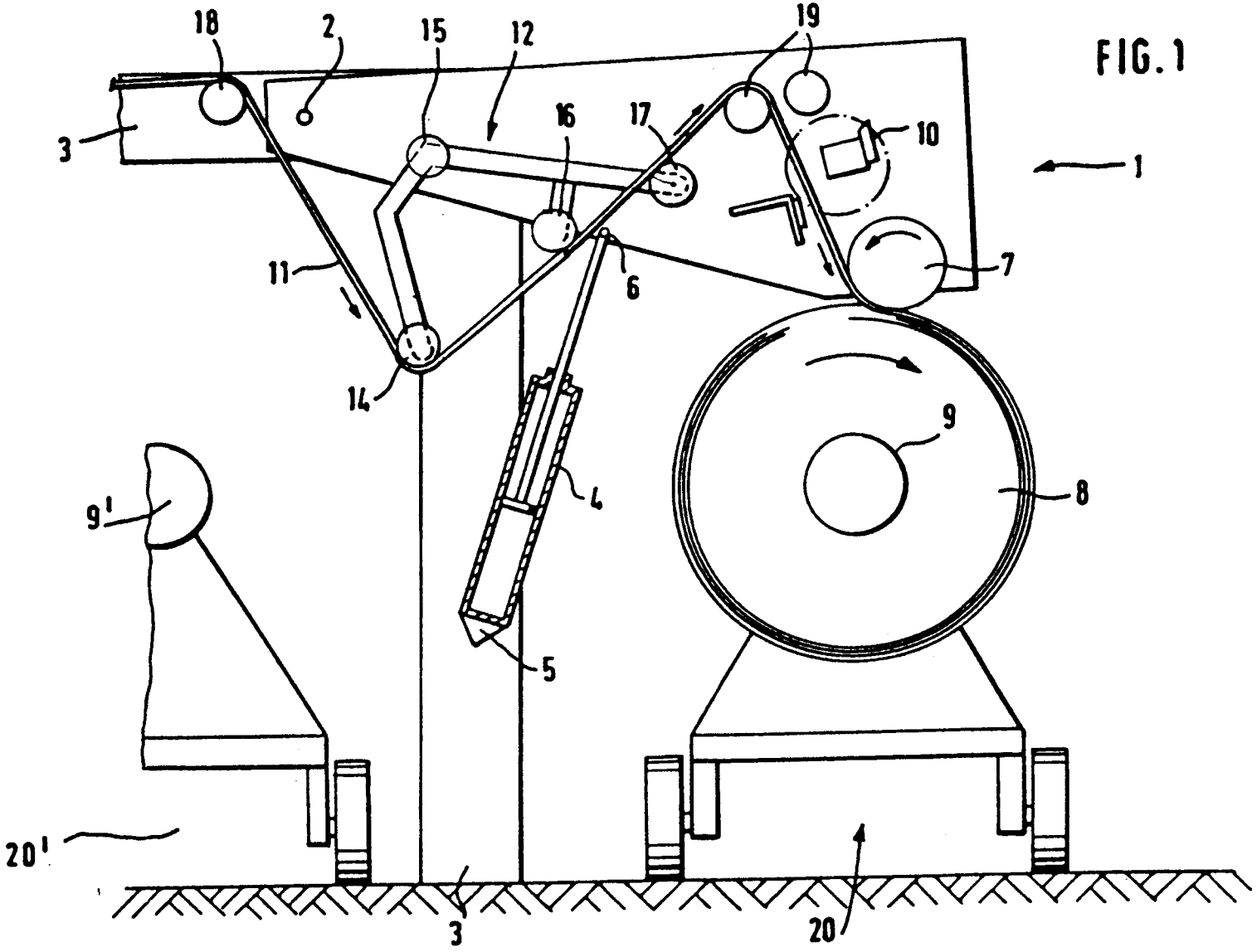
FIG. 1 shows the apparatus just before completion of a coil on a first takeup roll.

The apparatus consists essentially of a roll stand 1 which is pivotable about an axle 2 in stationary frame 3. Through a cylinder-piston rod unit 4 disposed on both sides of the apparatus, which unit is mounted on the roll stand 1 or on the frame 3 through pivots 5 and 6, the roll stand 1 can be pivoted up and down.

In the reqion of its free end the roll stand 1 is provided with a drive roll 7 which can be pressed against the outer circumference of a coil 8 being formed on first takeup roll 9, to wind the latter up to a certain diameter.

Roll stand 1 is equipped with a rotatable cutter 10 known per se, to cut, after completion of coil 8, the full width of fabric 8 running in the direction of the arrow. A cradle 12 is pivotable about an axle 13 (FIG. 2) in rol stand 1. The cradle is fitted with a group of guide rolls 14, 15, 16 and 17, the roll 17, like the cradle 12 being mounted on axle 13. The web 11 is arrayed over guide rolls 14, 16, the web thereafter extending onto the takeup roll 9. Between the guide roll 17 and the cutter 10 upstream of the drive roll 7 in the running direction of the fabric web 11 there are arranged two traction rolls 19 adapted to be pressed toward one another. The fabric web 11 is guided between rolls 19 at least one of which is driven to thereby form a second web drive.

Figure 2:
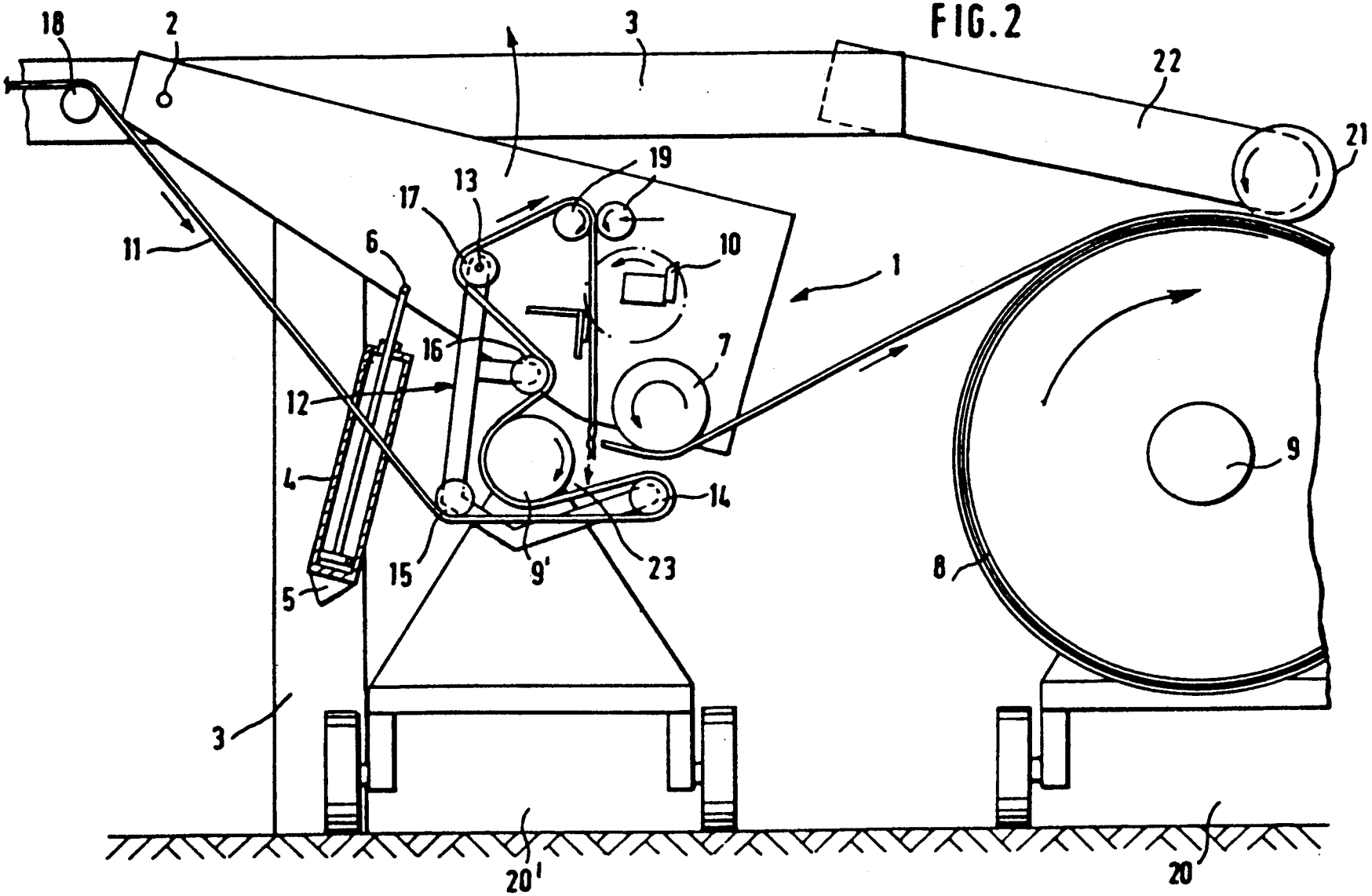
FIG. 2 the apparatus after displacement of the first wound takeup roll and coupling of the end to the second takeup roll.

As soon as coil 8 has reached the intended diameter, it is moved, by means of a carriage 20 on which takeup roll 9 is freely rotatable, from the position shown in FIG. 1 into the position shown in FIG. 2. During this process, the coil 8 is still driven by an additional drive roll 21 which applies against coil 8 and is supported by pivot arms 22 articulated at frame 3.

Into the cleared starting position of the first takeup roll 9 a second takeup roll 9' is then moved by a carriage 20', and the roll stand 1 and with it the cradle 12 are pivoted so that the periphery of takeup roll 9' is partly looped by the fabric web 11 still coming in at unchanged speed as a result of the drive of the rolls 19. The takeup roll 9' is in turn driven by contact with the driven fabric. Below the pressed together second drive means formed by the rolls 19 there is thus formed a gap 23 narrowing in feed direction of the web into which the free end of the web, having been cut by cutter 10, is introduced. The incoming speed of the fabric web 11 is now maintained solely by the rolls 19. The looping of the takeup roll 9' by fabric web 11 ensures that roll 9' is likewise driven at the incoming speed of fabric web 11.

When in this manner the joining process on the winding roll 9' has been completed after several loopings, cradle 12 with the guide rolls 14 to 17 is pivoted back to the position shown in FIG. 1, after the drive roll 7 is pressed against the forming new coil so that drive roll 7 takes over the drive which up until then was ensured by the rolls 19.

In the apparatus according to the invention, therefore, the fabric web is itself used directly as means for driving each new takeup roll 9' and for pressing the fabric web beginning firmly against the outer circumference of takeup roll 9' so that special auxiliary means such as adhesive tapes are not necessary.

From the foregoing it will be appreciated that there is provided, in accordance with the invention, a novel method and apparatus for uninterruptedly shifting the cut end of an advancing web to a second take up roll after a first takeup roll is filled. The method and apparatus eliminate the necessity of providing ancillary connection means such as adhesives.

As will be apparent to those skilled in the art and familiarized with the instant disclosure, numerous variations in details of construction may be made without departing from the spirit of the invention. Accordingly, the same should be broadly construed within the scope of the appended claims.

I claim:

1. Method for sequentially winding first and second takeup rolls from a running fabric web increments of which are sequentially severed perpendicular to the feed direction comprising driving said first takeup roll to which a lead edge of said web is secured, forming a loop in said driven web, said loop including a vertical component, shifting said second takeup roll along a horizontal path into engagement with said vertical component of said running web to array said web partially about the periphery of said second roll thereby to cause said web to drive said second takeup roll at a linear speed corresponding to the speed of advance of said web and to define a gap narrowing in the direction of fabric feed between said second takeup roll and said web, completely severing said web transversely to the feed direction at a position intervening between said first and second takeup rolls, and thereafter introducing the completely severed free end of said web into said gap to thereby clamp said severed end of said end between said second roll and said web.

2. The method of claim 1 and including the step of providing a first drive means for deriving said first takeup rolls, providing a second drive means spaced from said second roll for driving said web independent of said first drive means, and advancing said web using said second drive means following said severing step.

3. Method in accordance with claim 2 and including the step of coupling said second takeup roll with said first drive means after said severed end is clamped to said second takeup roll.

4. Apparatus for sequentially loading first and second takeup rolls from a running web of fabric moving in a path perpendicular to the axis of said rolls comprising means for shifting said rolls along a horizontal path perpendicular to heir longitudinal axis toward and away from said path, first drive means disposed in a first position engaging coils of said web on said first take up roll to thereby advance said web, guide means in said path of said running web for forming a transversely directed loop in said web, said loop including a vertical component, second drive means interposed between said first takeup roll and said guide means for feeding said web in said running direction independently of said first drive means, transverse cutter means positioned in said path between said takeup roll and said second drive means for severing said web, means for shifting the periphery of said second takeup roll along a horizontal path into driven engagement with said vertical component of said loop in said web and for forming a gap between said second takeup roll and said web, and means for introducing a fully severed end of said web into said gap to thereby drivingly connect said severed end and said second takeup roll.

5. Apparatus in accordance with claim 4 wherein said first drive means is movably mounted and adapted to be shifted from said first position to a second position drivingly engaging coils of said web on said second takeup roll.

6. Apparatus in accordance with claim 5 wherein said guide means comprises a cradle having a plurality of rollers extending transversely of said web and said vertical component of said loop comprises a portion of said web extending between and spaced from said rollers.

7. Apparatus in accordance with claim 6 wherein said cradle is pivotally mounted for movement about a horizontal pivot axis toward and away from said second takeup roll.

8. Apparatus in accordance with claim 7 wherein said cradle includes fist and second adjoining legs angularly oriented relative to each other, a third leg projecting from one of said first and second legs, first , second, third, and fourth guide rollers disposed at the ends of said legs and extending transversely across said web, the roller at the end of said third leg being rotatable about an axis coincident with said horizontal pivot axis.

9. Apparatus in accordance with claim 4 and including piston and cylinder means operatively connected to said first drive means for shifting said first drive means toward and away from said first position.

10. The method of causing a completely severed end of a running web to be coupled to a takeup roll, which comprises the steps of causing said web to move in a path perpendicular to the axis of said roll, said path including a transversely directed loop having a vertical component, horizontally shifting the periphery of said takeup roll against said vertical component of said loop to thereby cause said web to rotate said takeup roll about said axis and to define with said takeup roll a gap narrowing in the running direction of said web, and thereafter introducing said cut end in a downward direction into said gap to thereby alone clamp said end between said web and said roll.

* * * * *